United States Patent [19]

Numata et al.

[11] 3,992,622

[45] Nov. 16, 1976

[54] LOGARITHMIC AMPLIFIER WITH TEMPERATURE COMPENSATION MEANS

[75] Inventors: Saburo Numata; Shinichiro Fujino, both of Urawa; Masanoshin Komori, Omiya, all of Japan

[73] Assignee: Fuji Photo Optical Co., Ltd., Omiya, Japan

[22] Filed: Nov. 21, 1975

[21] Appl. No.: 634,145

[30] Foreign Application Priority Data

Nov. 25, 1974 Japan ..... 49-135747

[52] U.S. Cl. ..... 250/214 C; 307/230; 307/311; 328/145

[51] Int. Cl.[2] ..... G06G 9/00

[58] Field of Search ..... 307/230, 311; 328/142, 328/144, 145; 250/214 C

[56] References Cited

UNITED STATES PATENTS

| | | | |
|---|---|---|---|
| 3,448,289 | 6/1969 | Harris | 328/145 X |
| 3,624,409 | 11/1971 | Folsom et al. | 328/145 X |

*Primary Examiner*—John Zazworsky

[57] ABSTRACT

In a logarithmic amplifier employing a log-diode connected across an operational amplifier, a dividing resistor and a transistor circuit are connected in parallel between the output of the operational amplifier and the log-diode. The temperature characteristic of the log-diode and that of the transistor circuit cancel each other to effect temperature compensation in the output of the operational amplifier.

3 Claims, 5 Drawing Figures

LOGARITHMIC AMPLIFIER WITH TEMPERATURE COMPENSATION MEANS

BACKGROUND OF THE INVENTION

1. Field of the Invention

This invention relates to a logarithmic amplifier, and more particularly to a logarithmic amplifier employing a log-conversion element such as a semiconductor diode provided with means for temperature compensation of the output thereof.

2. Description of the Prior Art

In a logarithmic amplifier employing a log-conversion element such as a semiconductor diode, the temperature compensation should be made for various range of current since the temperature coefficient of the diode varies as the amount of current flowing therethrough varies. Therefore, in the conventional logarithmic amplifiers, one or more steps of amplifiers are added and the amplification factor of the amplifiers is temperature compensated over the wide range of current by use of a thermistor or the like. Such a logarithmic amplifier employing a thermistor cannot be made into a monolithic form of small size.

SUMMARY OF THE INVENTION

The primary object of the present invention is, therefore, to provide a logarithmic amplifier having temperature compensation means including only semiconductors and resistors.

Another object of the present invention is to provide a logarithmic amplifier which can easily be made into a monolithic form of small size.

The logarithmic amplifier in accordance with the present invention is characterized in that a transistor amplifier and a dividing resistor are connected in parallel between the output of an operational amplifier and a log-conversion diode therein, whereby the temperature characteristic of the diode and that of the transistor amplifier cancel each other to completely compensate for the temperature variation.

DESCRIPTION OF THE PREFERRED EMBODIMENTS

Figure 1:
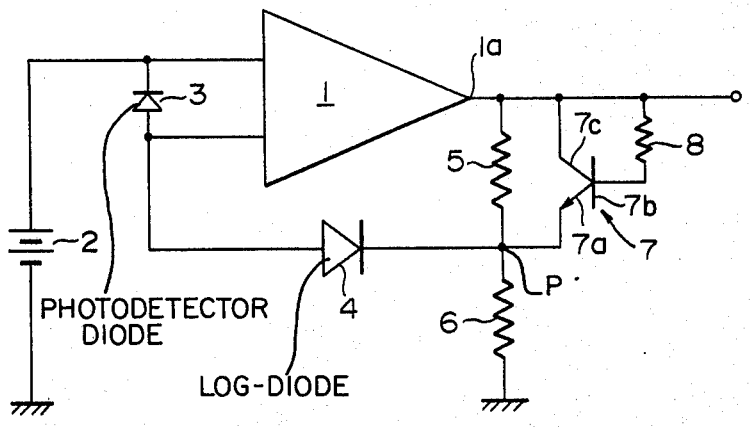
FIG. 1 is a diagram showing an embodiment of the logarithmic amplifier in accordance with the present invention.

Referring to FIG. 1 which shows an embodiment of the present invention, an operational amplifier 1 is connected with a power source 2 and provided with a photodetector 3 such as a silicon blue cell. Since the photodetector 3 allows only a small amount of current of about $10^{-12}$ to $10^{-4}$ A to flow therethrough, the operational amplifier 1 is of the type of high input impedance such as MOS-top operational amplifier, i.e. a Metal Oxide Semi-Conductor top operational amplifier. A log-conversion semiconductor element (hereinbelow referred to as "log-diode") 4 is connected across the operational amplifier 1 with the anode thereof connected with the photodetector 3 and the cathode thereof connected with a first dividing resistor 5 which is connected between the output 1*a* of the operational amplifier 1 and the log-diode 4. A second dividing resistor 6 is connected between the cathode of the log-diode 4 and the ground. A transistor 7 is connected in parallel with the first resistor 5 with the collector 7*c* thereof connected with the output 1*a* of the operational amplifier 1, the emitter 7*a* thereof connected with the connecting point P between the first resistor 5 and the second resistor 6, and the base 7*b* thereof connected with the output 1*a* of the operational amplifier 1 by way of a resistor 8.

In operation of the above described logarithmic amplifier as shown in FIG. 1, current generated through the photodetector 3 upon receipt of light mostly flows through the log-diode 4 since the input impedance of the operational amplifier 1 is extremely high. Therefore, the voltage at the connecting point P of the two resistors 5 and 6 becomes to be of the level lower than the reference voltage of the power source 2 by the amount corresponding to the voltage drop caused by the log-diode. Accordingly, the output voltage of the operational amplifier 1 becomes a function of the intensity of the light received by the photodetector 3 and the resistance of the first dividing resistor 5 when considered without the transistor 7.

Figure 3:
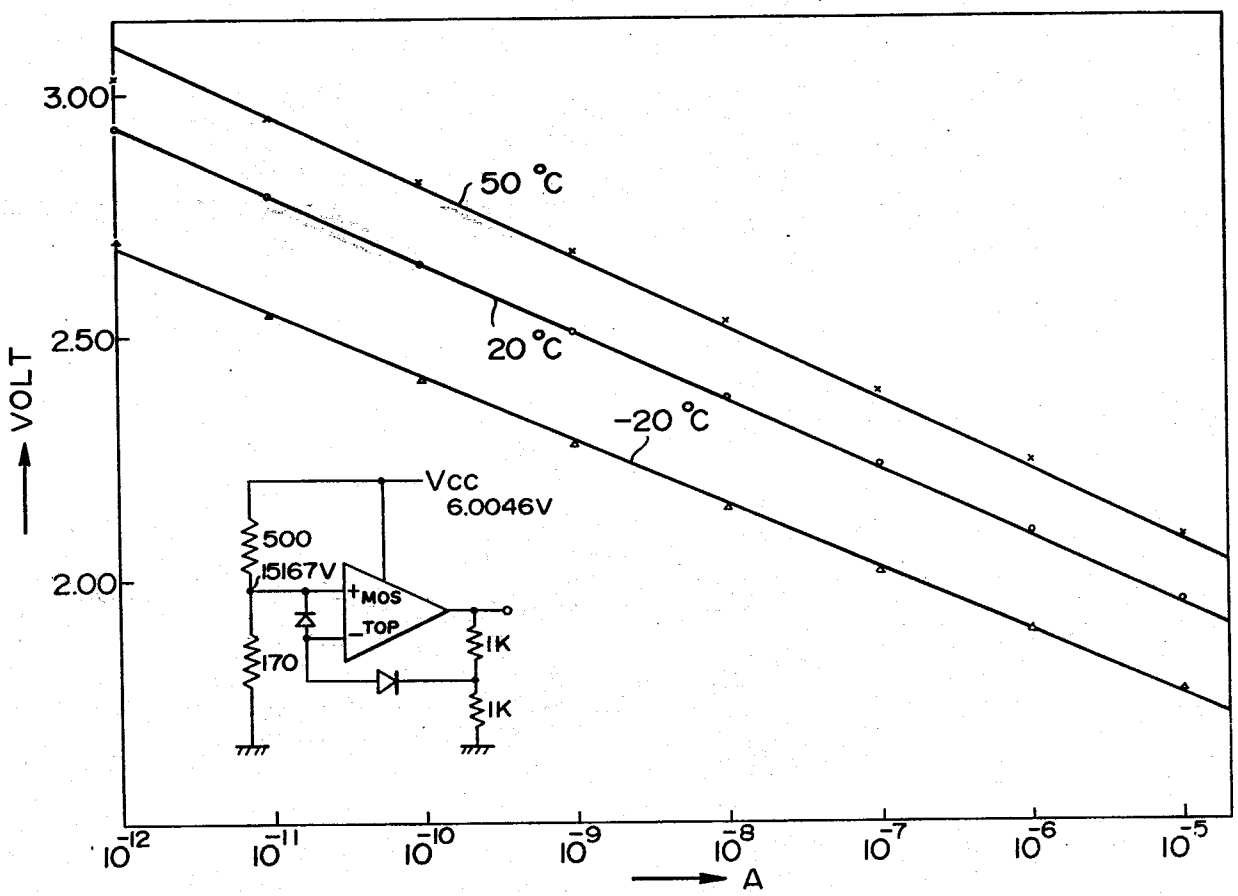
FIG. 3 is a graphic representation showing the temperature characteristic of the logarithmic amplifier which is not provided with the temperature compensation means.
Figure 4:
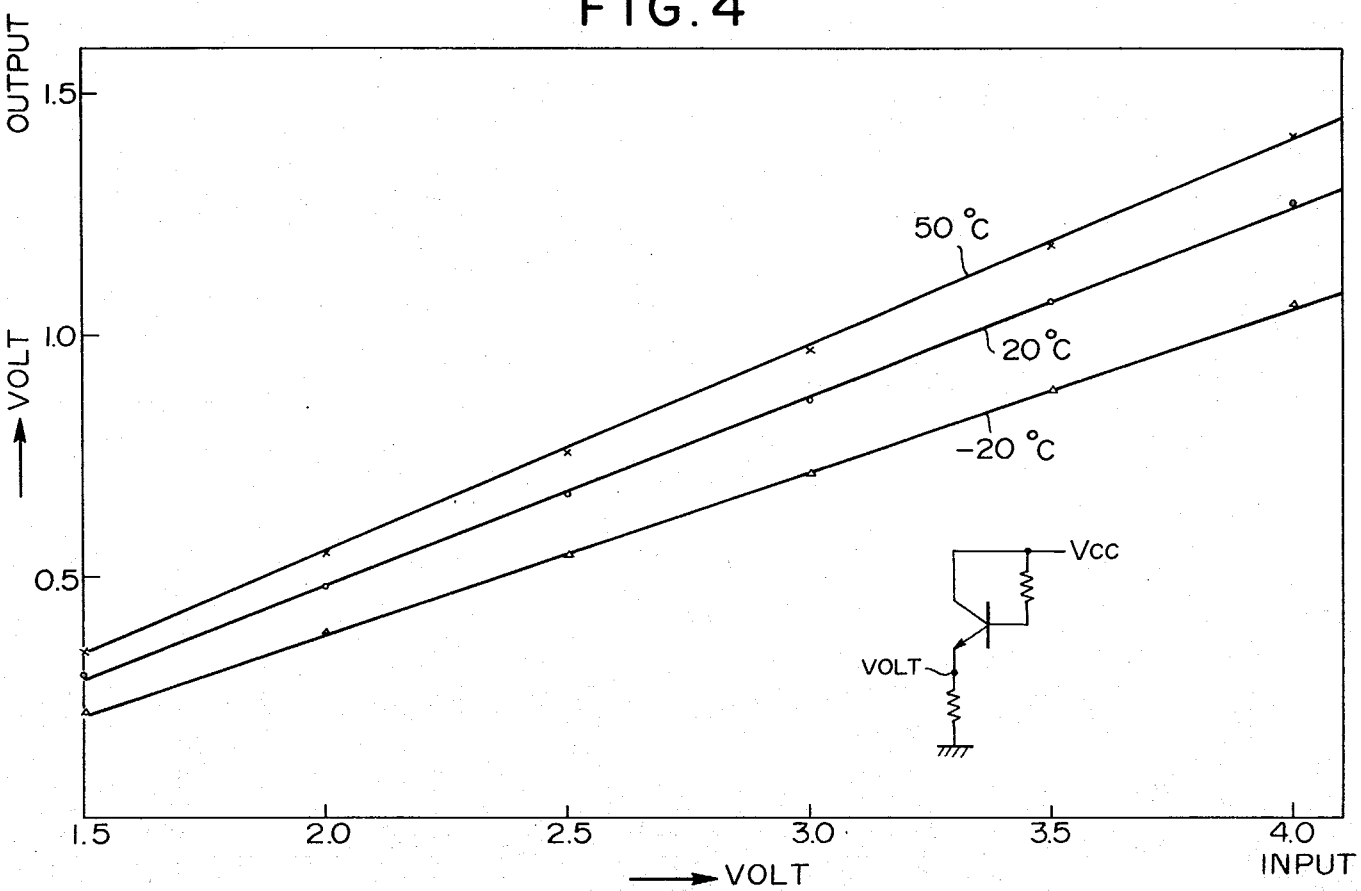
FIG. 4 is a graphic representation showing the temperature characteristic of the transistor amplifier connected with the logarithmic amplifier for temperature compensation in accordance with the present invention.
Figure 5:
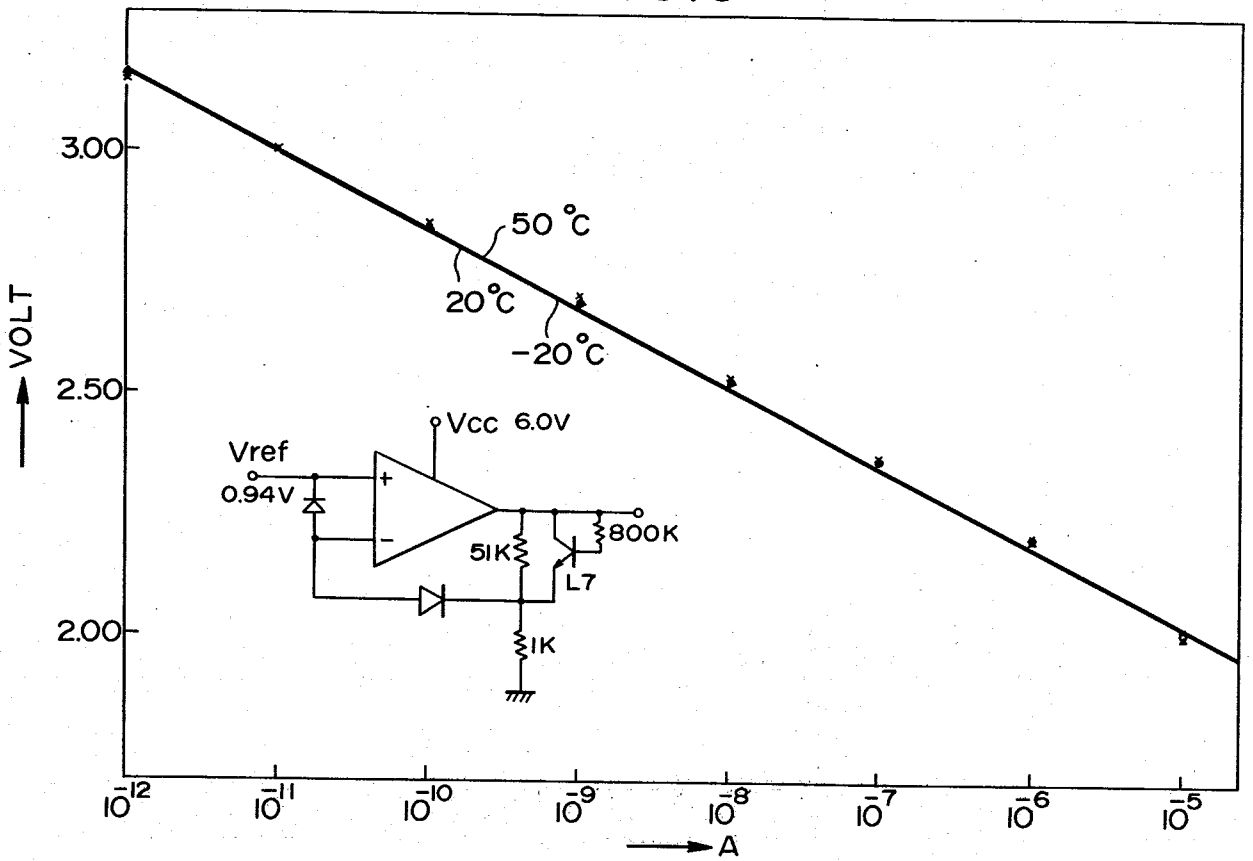
FIG. 5 is a graphic representation showing the temperature characteristic of the logarithmic amplifier with the temperature compensation means in accordance with the present invention.

The temperature coefficient of the log-diode 4 is varied when the current flowing therethrough, i.e. the intensity of the light received by the photodetector 3 varies. The temperature coefficient of the emitter current flowing through the transistor 7 is varied when the output voltage of the operational amplifier 1 varies. FIG. 3 shows the variation in the temperature coefficient based on the log-diode 4, and FIG. 4 shows the variation in the temperature coefficient based on the transistor 7. Since the variation in the temperature coefficient based on the log-diode 4 and that of the transistor 7 are in the form to offset each other, the influence of variation in temperature on the output of the operational amplifier is cancelled by combining the transistor circuit consisting of the transistor 7 with the logarithmic amplifier including the log-diode 4 and the dividing resistors 5 and 6. Since the temperature coefficient of the emitter current of the transistor 7 can be changed by changing the base resistor 8, the temperature compensation can be completely made by adjusting the resistance of the base resistor 8 over the whole range of current of the log-diode 4. The output of the operational amplifier 1 which is completely temperature compensated is shown in FIG. 5.

Figure 2:
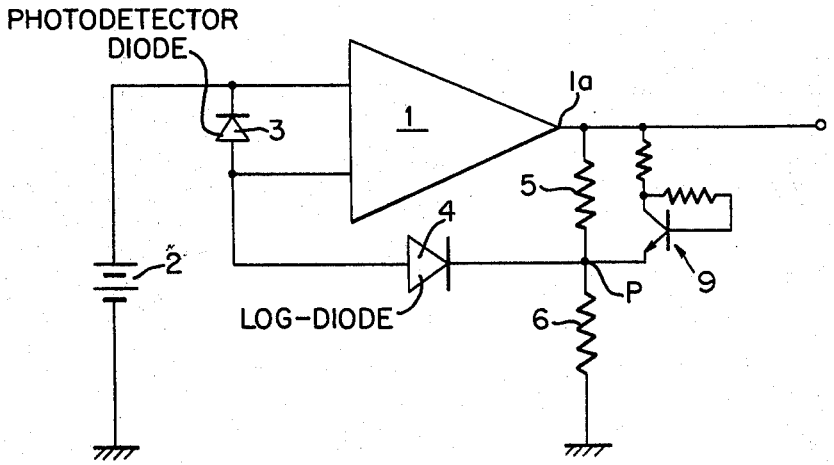
FIG. 2 is a diagram showing another embodiment of the logarithmic amplifier in accordance with the present invention.

A second embodiment of the present invention is shown in FIG. 2. In contrast to the first embodiment shown in FIG. 1 and described hereinabove wherein a fixed bias type transistor amplifier is employed, a self-bias type transistor amplifier 9 is employed in the second embodiment of the invention shown in FIG. 2.

We claim:

1. A logarithmic amplifier with temperature compensation means comprising in combination:

an operational amplifier having high input impedance, a photodetector connected across the inversion input and non-inversion input of the operational amplifier, a log-diode the anode of which is connected with said photodetector, a first dividing resistor connected between the output of said operational amplifier and the cathode of said log-diode, a second dividing resistor connected between the cathode of said log-diode and the ground, and a transistor the collector of which is connected with the output of said operational amplifier and the emitter of which is connected with the cathode of said log-diode, whereby the temperature characteristic of the log-diode and that of the amplification factor of said transistor offset each other.

2. A logarithmic amplifier as claimed in claim 1 wherein said transistor constitutes a fixed bias type amplifier.

3. A logarithmic amplifier as claimed in claim 1 wherein said transistor constitutes a self-bias type amplifier.

* * * * *